US010390583B2

(12) United States Patent
Smith, III

(10) Patent No.: US 10,390,583 B2
(45) **Date of Patent: *Aug. 27, 2019**

(54) FOOTWEAR WITH REFRACTIVE INTERNAL ILLUMINATION

(71) Applicant: Roy Robert Smith, III, Sugar Land, TX (US)

(72) Inventor: Roy Robert Smith, III, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/838,294

(22) Filed: Dec. 11, 2017

(65) Prior Publication Data

US 2018/0098596 A1 Apr. 12, 2018

Related U.S. Application Data

(63) Continuation of application No. 15/698,551, filed on Sep. 7, 2017, now abandoned, which is a continuation-in-part of application No. 15/093,505, filed on Apr. 7, 2016, now Pat. No. 9,781,967, application No. 15/838,294, which is a continuation-in-part of application No. PCT/IB2016/053752, filed on Jun. 23, 2016.

(60) Provisional application No. 62/188,576, filed on Jul. 3, 2015.

(51) Int. Cl.

| | |
|---|---|
| ***A43B 23/00*** | (2006.01) |
| ***A43B 3/00*** | (2006.01) |
| ***A43B 3/12*** | (2006.01) |
| ***A43B 1/00*** | (2006.01) |
| ***A43B 23/07*** | (2006.01) |

(52) U.S. Cl.

CPC ..... *A43B 3/001* (2013.01); *A43B 1/0072* (2013.01); *A43B 3/0005* (2013.01); *A43B 3/0078* (2013.01); *A43B 3/12* (2013.01); *A43B 23/07* (2013.01)

(58) Field of Classification Search

CPC ..... A43B 3/001; A43B 3/0005; A43B 3/0015; A43B 3/30; A43B 3/0078; A43B 1/0072; A43B 1/0027; A43B 1/0036; A43B 23/24; A43B 23/07

USPC ..... 36/136, 137, 139, 112

See application file for complete search history.

(56) References Cited

U.S. PATENT DOCUMENTS

| | | | | |
|---|---|---|---|---|
| 2,557,663 A * | 6/1951 | Knode | ..... | A43B 3/0078 313/289 |
| 4,020,572 A * | 5/1977 | Chiaramonte, Jr. | ..... | A43B 1/0036 36/137 |
| 4,158,922 A * | 6/1979 | Dana, III | ..... | A43B 1/0036 36/137 |

(Continued)

*Primary Examiner* — Jameson D Collier

(57) ABSTRACT

A footwear with refractive internal illumination has a footwear, a translucent body, an illumination system and a liner. The footwear has a sole section and an upper. The upper has an opaque light refracting section. The illumination system has a power source and at least one light source. The at least one light source is electrically connected to the power source. A light wavelength of light emitted from the at least one light source is approximate to a light wavelength of light emitted through the opaque light refracting section. The upper is connected to the sole section. The at least one light source is connected to the translucent body. The translucent body is housed in between the liner and the opaque light refracting section.

10 Claims, 16 Drawing Sheets

(56) References Cited

U.S. PATENT DOCUMENTS 5,052,131 A * 10/1991 Rondini ..... A43B 1/0072 36/11.5
5,577,828 A * 11/1996 Nadel ..... A41D 27/085 36/137
5,821,858 A * 10/1998 Stone ..... A43B 1/0036 340/573.1
5,857,273 A * 1/1999 Rapisarda ..... A43B 1/0036 36/136
5,879,069 A * 3/1999 Chien ..... A43B 1/0072 36/137
5,930,921 A * 8/1999 Sorofman ..... A43B 1/0072 36/137
6,082,867 A * 7/2000 Chien ..... A43B 1/0072 313/512
7,147,342 B2 * 12/2006 Burnidge ..... A45C 13/28 362/156
8,056,269 B2 * 11/2011 Beers ..... A43B 1/0027 36/137
8,327,561 B1 * 12/2012 Smith, III ..... A43B 3/001 36/137
8,641,220 B1 * 2/2014 Lin ..... F21V 31/005 36/137
2003/0145494 A1 * 8/2003 Hsu ..... A43B 1/0036 36/137
2003/0231487 A1 * 12/2003 Chien ..... A41D 27/085 362/84
2004/0022052 A1 * 2/2004 Chien ..... A43B 3/0005 362/84
2004/0233658 A1 * 11/2004 Hsu ..... A43B 3/0005 362/84
2005/0018417 A1 * 1/2005 Chien ..... A43B 1/0036 362/103
2005/0259410 A1 * 11/2005 Chiang ..... A43B 1/0036 362/103
2006/0053663 A1 * 3/2006 Mao ..... A43B 3/0005 36/137
2006/0245191 A1 * 11/2006 Ratcliffe ..... G09F 9/33 362/246
2007/0151125 A1 * 7/2007 Tsai ..... A43B 3/0005 36/137
2010/0170115 A1 * 7/2010 Smith, III ..... A43B 1/0027 36/137
2010/0226116 A1 * 9/2010 Brainard ..... F21V 13/04 362/84
2011/0192059 A1 * 8/2011 Spanks ..... A43B 1/0072 36/137
2012/0188750 A1 * 7/2012 Marston ..... A43B 3/001 362/103
2012/0285047 A1 * 11/2012 Pacheco ..... A43B 3/001 36/137
2013/0239441 A1 * 9/2013 Chen ..... A43B 1/0072 36/137
2014/0157632 A1 * 6/2014 Kim ..... A43B 3/001 36/137
2014/0185275 A1 * 7/2014 Smith, III ..... A43B 3/001 362/103
2014/0352175 A1 * 12/2014 Katz ..... A43B 3/242 36/100
2015/0250263 A1 * 9/2015 Robinson, Jr. ..... A43B 23/24 36/84
2016/0198788 A1 * 7/2016 Larsen ..... A43B 3/001 362/103
2016/0219967 A1 * 8/2016 Smith ..... A43B 3/001

* cited by examiner

FOOTWEAR WITH REFRACTIVE INTERNAL ILLUMINATION

The current application claims benefit of U.S. Provisional Patent application Ser. No. 62/188,576 filed on Jul. 3, 2015, and U.S. patent application Ser. No. 15/093,505 filed on Apr. 7, 2016.

FIELD OF THE INVENTION

The present invention relates generally to footwear. More specifically, the present invention relates to a footwear with refractive internal illumination.

BACKGROUND OF THE INVENTION

Light is electromagnetic waves which comprise an enormous range of frequencies and this continuous range of frequencies is known as the electromagnetic spectrum. Within the electromagnetic spectrum is the spectrum of visible light, which is a very narrow band of wavelengths located to the right of the infrared region and to the left of the ultraviolet region. Each individual wavelength within the spectrum of visible light wavelengths is representative of a particular color. That is, when light of that particular wavelength strikes the retina of our eye, we perceive that specific color sensation. For example, we see grass as green because grass absorbs all light frequencies of wavelength except green which it reflects back. Though electromagnetic waves exist in a vast range of wavelengths, our eyes are sensitive to only a very narrow band. Since this narrow band of wavelengths is the means by which humans see, we refer to it as the visible light spectrum and it was Isaac Newton that divided the light spectrum into seven named colors, Red, Orange, Yellow, Green, Blue, Indigo and Violet.

When all the wavelengths of the visible light spectrum strike your eye at the same time, white is perceived. The sensation of white is not the result of a single color of light. Rather, the sensation of white is the result of a mixture of two or more colors of light. Technically speaking, white is not a color at all, at least not in the sense that there is a light wave with a wavelength that is characteristic of white. Rather, white is the combination of all the colors of the visible light spectrum. If all the wavelengths of the visible light spectrum give the appearance of white, then none of the wavelengths would lead to the appearance of black. Once more, black is not actually a color. Technically speaking, black is merely the absence of the wavelengths of the visible light spectrum.

A red laser will pop all colors of a balloon except for red and white. A red laser does not pop a red balloon because the wavelength of the red laser matches the wavelength of the red balloon, thus the red laser simply reflects off the surface of the red balloon. White on the other hand, reflects the full light spectrum, thus all wavelengths of light reflect off a white balloon, therefore no color of laser will pop a white balloon.

Light has several optical properties of interest, especially relating to how light behaves at the boundary between mediums. Generally light is refracted or reflected at boundaries, and in some cases both phenomena occur. With the appropriate configurations, such refractions and reflections can be manipulated to internally illuminate physical bodies, such as components of a footwear. The internally illuminated effect is enhanced by providing for multiple refractions of light, which result in amplified brightness and intensity of observed light.

The present invention describes a number of applications based on twice-refracted light with regards to footwear. Twice-refracted light benefits a variety of footwear types, including both open footwear such as sandals and closed footwear such as boots. The twice-refracted light (resulting from internal refraction) is not only a new innovation for illuminated footwear, it also enhances additional visual features e.g. letters, logos, and further aesthetic designs.

DETAIL DESCRIPTIONS OF THE INVENTION

Figure 1:
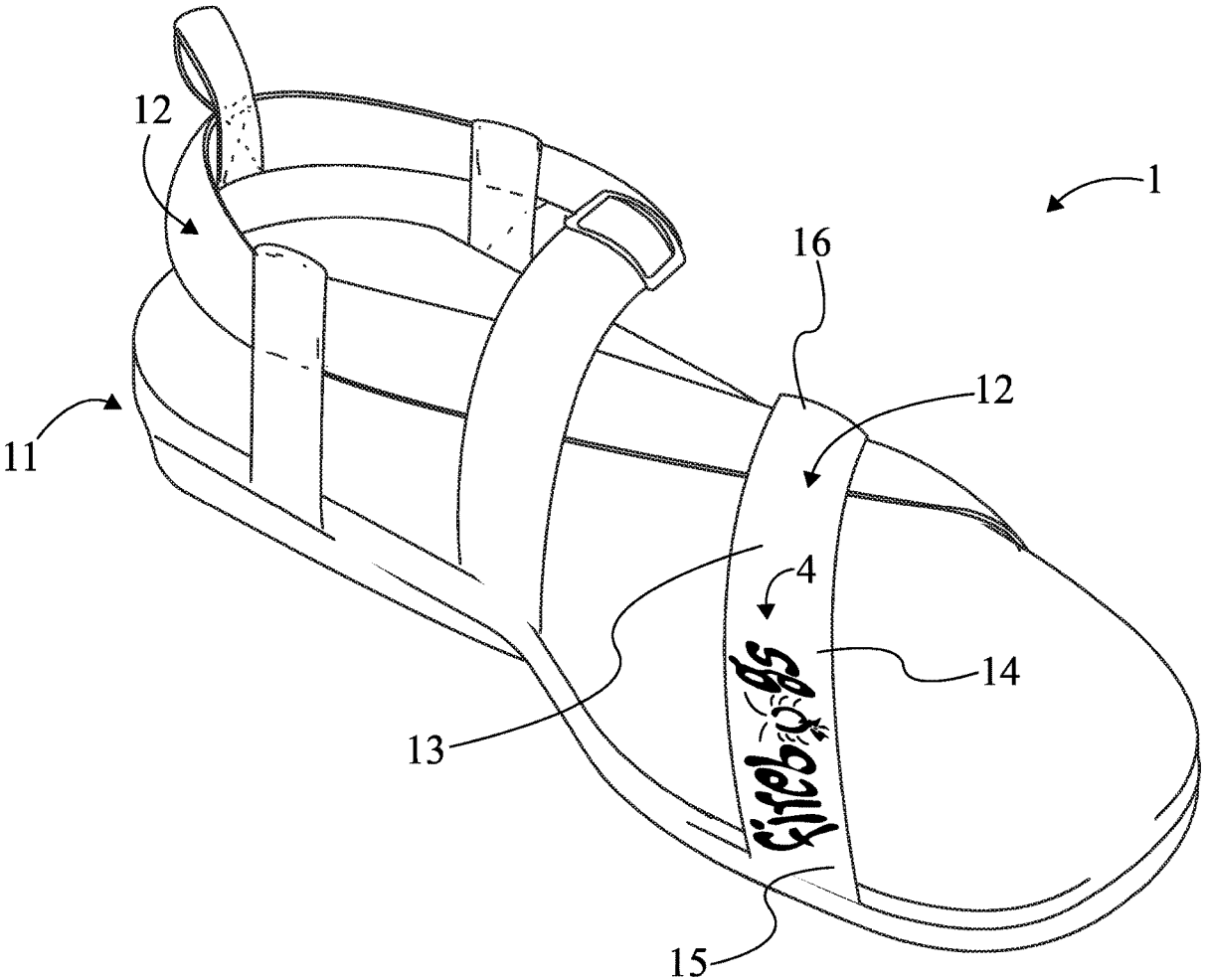
FIG. 1 is a perspective illustration showing an open footwear embodiment of the present invention.

All illustrations of the drawings are for the purpose of describing selected versions of the present invention and are not intended to limit the scope of the present invention.

While the present invention is described in relation to footwear 1, the present invention may be adapted for other categories including backpacks, hats, outwear, safety vests, pet collars, leashes, and vests.

The present invention is a new innovation for illuminated footwear 1 that applies twice-refracted light to create an enhanced internal illumination effect. To this end, the present invention comprises a footwear 1, a translucent body 2, and an illumination system 3. The illumination system 3 is connected to the translucent body 2, and is integrated into the footwear 1 in order to produce the twice-refracted internal illumination. The footwear 1, more specifically, comprises a sole section 11 and an upper 12. The illumination system 3 comprises a power source 31, electrical wires 311 and an at least one light source 32. In an open footwear embodiment, the upper 12 comprises at least one cylindrical elongated opaque strap 13. In a closed footwear embodiment, the upper 12 comprises an opaque light refracting section 18. Whereby the at least one light source 32 is connected to the translucent body 2. The translucent body 2 is housed within the upper 12, allowing it to internally illuminate the cylindrical elongated opaque strap 13 or the opaque light refracting section 18, of upper 12. The power source 31 is electrically connected to the at least one light source 32, by electrical wires 311. As later elaborated upon, different embodiments of the present invention may require different properties of the cylindrical elongated opaque strap 13 or the opaque light refracting section 18. More specifically, the cylindrical elongated opaque strap 13 or the opaque light refracting section 18 must be capable of refracting light, and reflecting light. Certain materials are considered to be suitable for the cylindrical elongated opaque strap 13 or the opaque light refracting section 18. For example, a nylon or polyester material that is opaque but also capable of refracting light is an ideal choice. Such material may be used in the production of footwear and may be formed into a strap or a cylindrical strap, which is typically used in the production of "sport" sandals, or formed into a flat sheet, which is typically used in the production of closed footwear, yet capable of refracting light.

Figure 2:
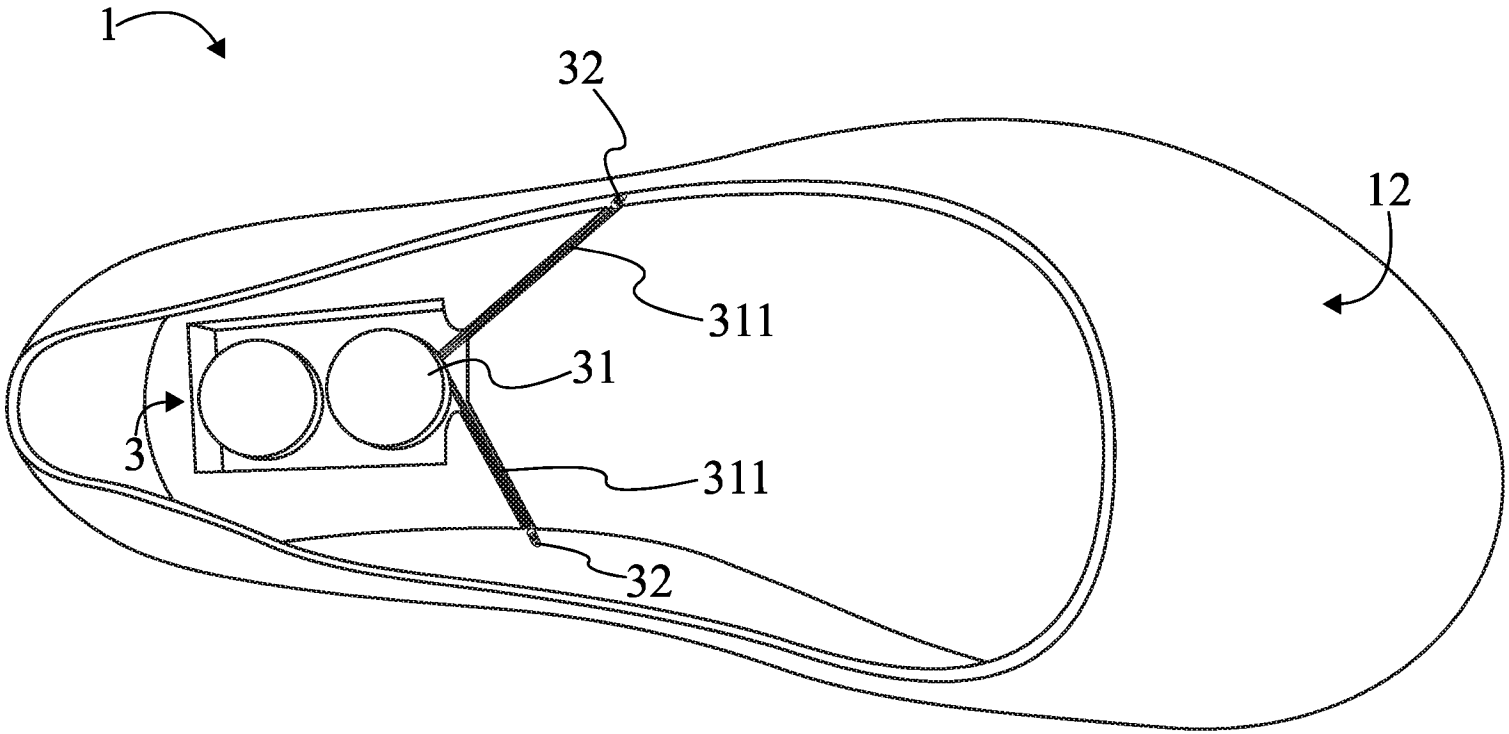
FIG. 2 is a top view illustration showing a closed footwear embodiment of the present invention, with illumination system visible.

Potentially, for a sandal style footwear 1 or a boot style footwear 1, the translucent body 2 enclosed within the upper 12 can be located in the sole section 11. In other words, a portion of the translucent body 2 may extend into the sole section 11. Correspondingly, the light source 32 (which is connected to the translucent body 2) is also housed within the sole section 11, as shown in FIG. 2. Alternatively, in the open footwear embodiment, for some constructions, while the first end 15 and the second end 16 of the cylindrical elongated opaque strap 13 are attached to the sole section 11, the connection point of the light source 32 is located at the base of the upper 12 rather than inside the sole section 11. In the closed footwear embodiment, for some constructions, while the opaque light refracting section 18 are attached to the sole section 11, the connection point of the light source 32 is located at the base of the upper 12 rather than inside the sole section 11.

Figure 3:
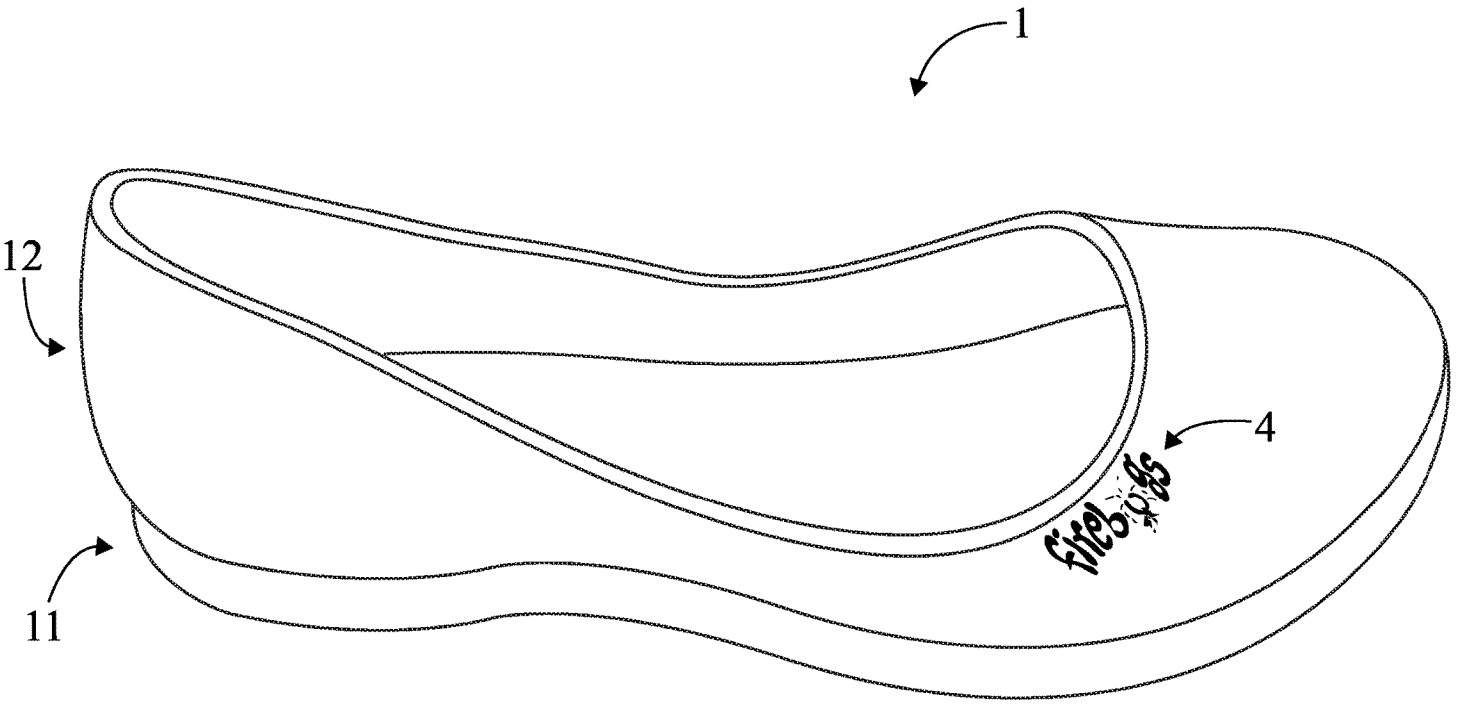
FIG. 3 is a right side illustration showing the closed footwear embodiment of the present invention, with an aesthetic design added.

The twice-refracted light of the present invention can be implemented into an open style footwear 1 (e.g. sandal or flip flop), as shown in FIG. 1. Alternatively, the twice-refracted light can be implemented into a closed style footwear 1 (e.g. a shoe or a boot), as shown in FIG. 2 and FIG. 3. While these and further embodiments of the present invention are possible, the utilization of twice-refracted light is constant across all embodiments of the present invention. Light, originating at the at least one light source 32, internally illuminates the translucent body 2, where light is then first refracted from the translucent body 2, reflected between the cylindrical elongated opaque strap 13 or the opaque light refracting section 18 and the translucent body 2, and again refracted a second time from the cylindrical elongated opaque strap 13 or the opaque light refracting section 18. The resulting twice-refracted light illuminates large surface areas, or entire surface areas of the cylindrical elongated opaque strap 13 or the opaque light refracting section 18 of the upper 12. The second refraction of light also completes the transfer of ornamentation from the translucent body 2 and along the exterior surface area of the cylindrical elongated opaque strap 13 or the opaque light refracting section 18 of the upper 12, as implemented by some embodiments (elaborated upon later) of the present invention.

The light emitted from the at least one light source 32 has a wavelength that is matching and or is approximate to that of the cylindrical elongated opaque strap 13 or the opaque light refracting section 18 of upper 12, which allows for the light to be refracted by the cylindrical elongated opaque strap 13 or the opaque light refracting section 18 after first being refracted by the translucent body 2. The cylindrical elongated opaque strap 13 or the opaque light refracting section 18 of upper 12 is thus internally illuminated, and can be further enhanced with ornamentations, by way of additional refraction on a separate indice as later detailed.

Figure 4:
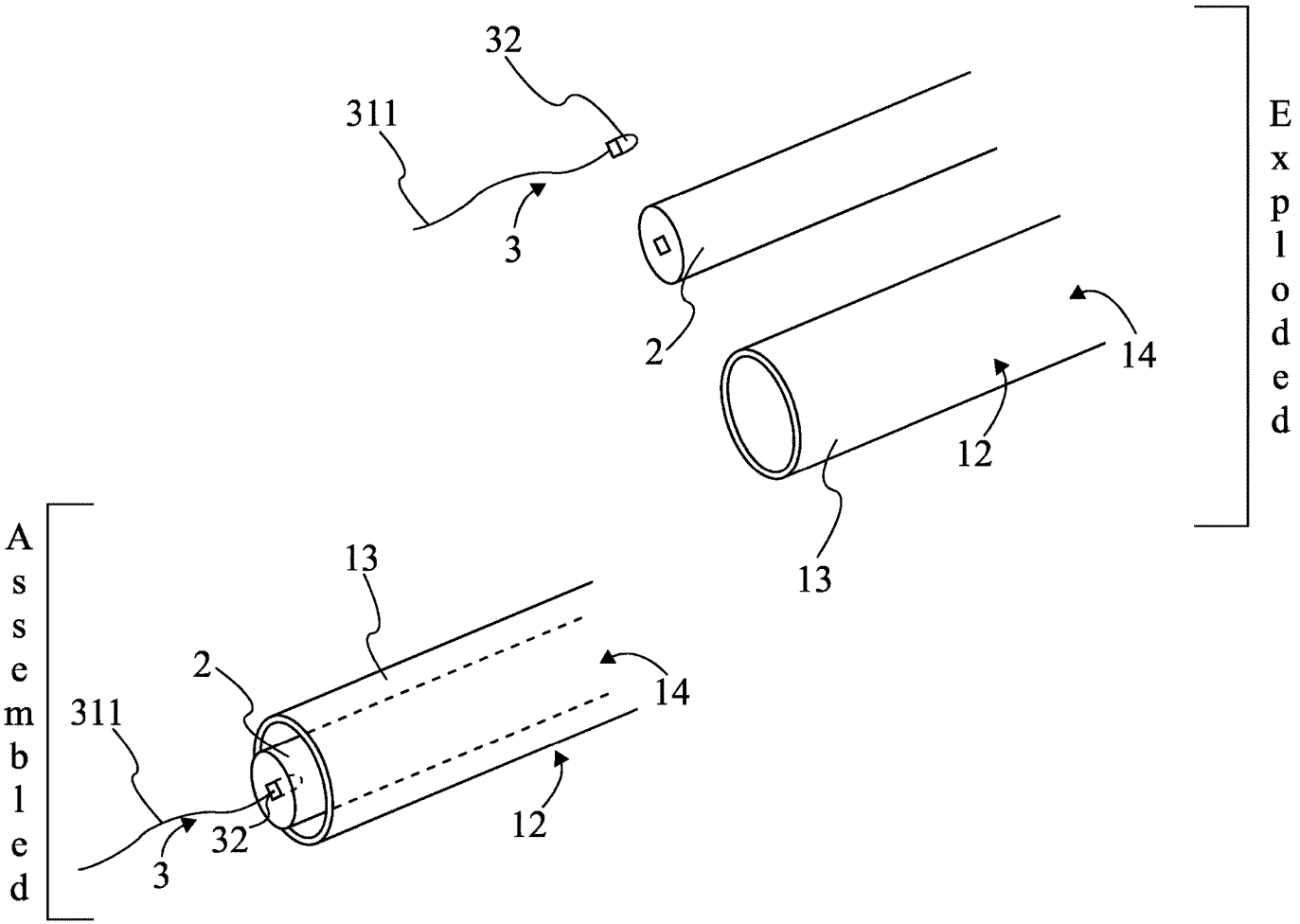
FIG. 4 is an assembly view showing a translucent body and an upper of the open footwear embodiment of the present invention.

In the open-footwear embodiment, the upper 12 comprises the at least one cylindrical elongated opaque strap 13. Such embodiments are not limited to a single strap; for example, two straps with a thong can be utilized. In this configuration, the translucent body 2 is enclosed within the cylindrical elongated opaque strap 13 of upper 12. That is, the cylindrical elongated opaque strap 13 serves as a sleeve for the translucent body 2. The cylindrical elongated opaque strap 13 could be partially opaque. In other words, the cylindrical elongated opaque strap 13 itself may comprise an opaque part and a light impermeable part 14. The cylindrical elongated opaque strap 13 itself preferably comprises the first end 15 and the second end 16, with each end being adjacently connected to the sole section 11 of the footwear 1. Resultantly, a gap between the cylindrical elongated opaque strap 13 and the sole section 11 is formed. A user's foot, or parts thereof, may be positioned in the formed gap. This allows for the cylindrical elongated opaque strap 13 to anchor a user's foot to the sole section 11. FIG. 4 shows an example cross section of the cylindrical elongated opaque strap 13 for this embodiment.

In a closed footwear embodiment, the upper 12 further comprises a liner 17. The liner 17 serves as a backing for the translucent body 2, as well as an interior layer of the upper 12. As with the cylindrical elongated opaque strap 13, which serves as a sleeve for the translucent body 2, the translucent body 2 is housed between the liner 17 and the opaque light refracting section 18 of upper 12. While the translucent body 2 is now encased by the opaque light refracting section 18, as with the first embodiment, the translucent body 2 is positioned adjacent to the opaque light refracting section 18 in order to create twice-refracted light as earlier elaborated upon. It is noted that while this embodiment is described as being for closed footwear, it could be applied to an open footwear such as a sandal; in such an adaptation, the liner 17 and the cylindrical elongated opaque strap 13 serve as a singularly flat strap which can be attached to the sole section 11 of a sandal or similar open footwear, while encasing the translucent body 2. The liner 17 may be made of a reflective material to enhance brightness and illumination of the present invention. An example of this is provided via FIG. 7.

In this closed footwear embodiment, it is possible to create ornamentations on the upper 12 through various means. Commonly, such ornamentations are alphanumeric or graphic images formed in combination with the translucent body 2, which is internally illumined by the at least one light source 32. The images can be "positive" or "negative". A positive image is one in which light refracted from the translucent body 2 illuminates the positive space, i.e. that of the image itself. A negative image is one in which the refracted light illuminates the negative space, i.e. the area around the image. A few examples of how images may be formed with this embodiment of the present invention are detailed below.

Figure 5:
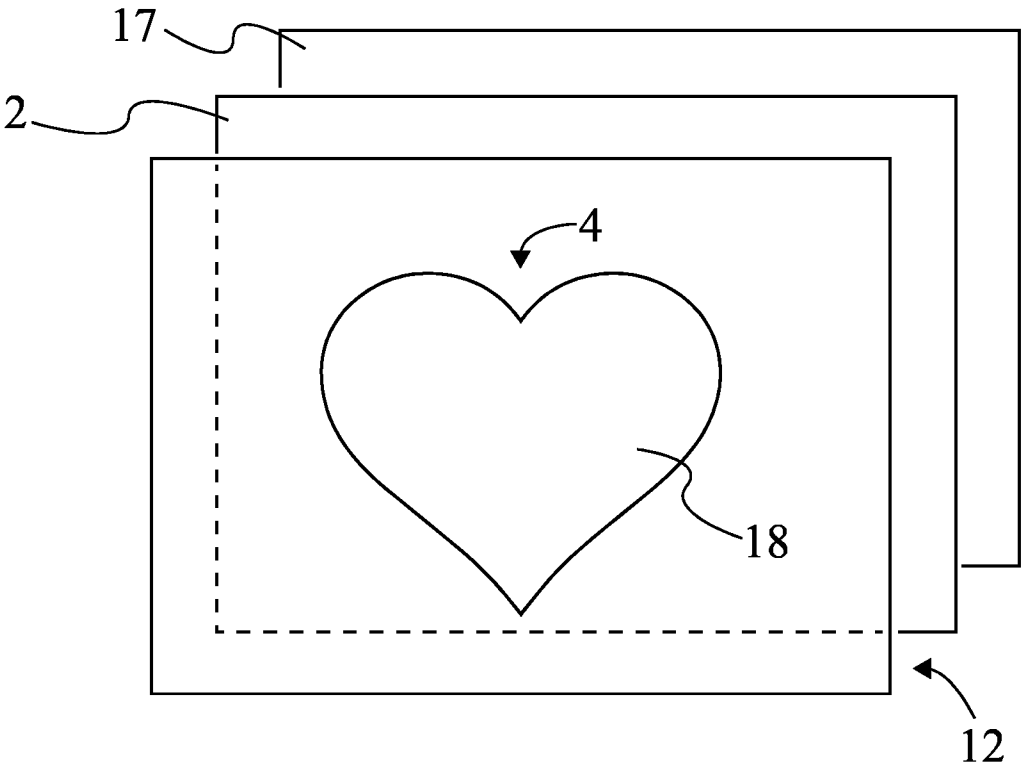
FIG. 5 is a layered view showing an aesthetic design created by a refractive section of an upper of the present invention.

Potentially, the upper 12 comprises the opaque light refracting section 18. The opaque light refracting section 18, like that of the cylindrical elongated opaque strap 13, is opaque and allows for twice refracted light to be viewed by an outside viewer (e.g. a person). The opaque light refracting section 18 is configured into an aesthetic design 4. The aesthetic design 4 can be writing (i.e. alphanumeric characters), an image (e.g. a logo), or a combination thereof. The aesthetic design 4 is formed as a positive image in this example; emitting twice refracted light in the form of the image, rather than of the negative space surrounding the image. This configuration is illustrated through FIG. 5.

Figure 6:
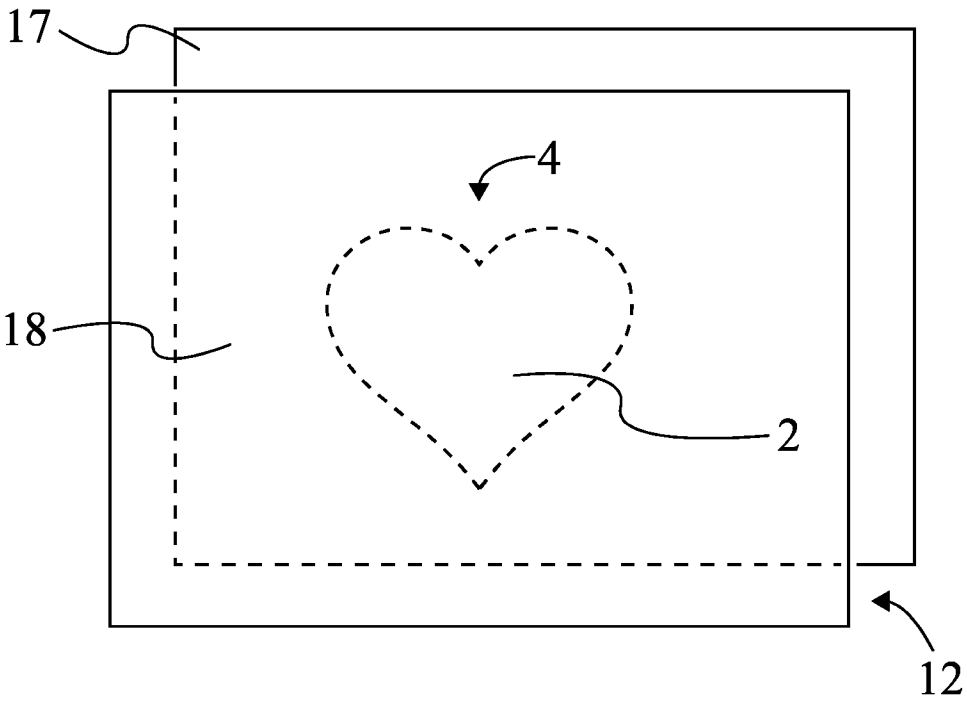
FIG. 6 is a layered view showing an aesthetic design created by a translucent body of the present invention.

In another example, the upper 12 comprises the opaque light refracting section 18. However, the opaque light refracting section 18 is not configured into an aesthetic design 4 as with the previous example. Instead, the translucent body 2 itself is configured into an aesthetic design 4. This still results in a positive image being formed, as described with the previous embodiment, but the aesthetic design 4 itself is created via the translucent body 2 rather than the opaque light refracting section 18. The translucent body 2 is adjacently connected to the opaque light refracting section 18 whereby the aesthetic design 4 appears across the opaque light refracting section 18 by way of twice refracted light. This configuration is illustrated in FIG. 6.

Figure 7:
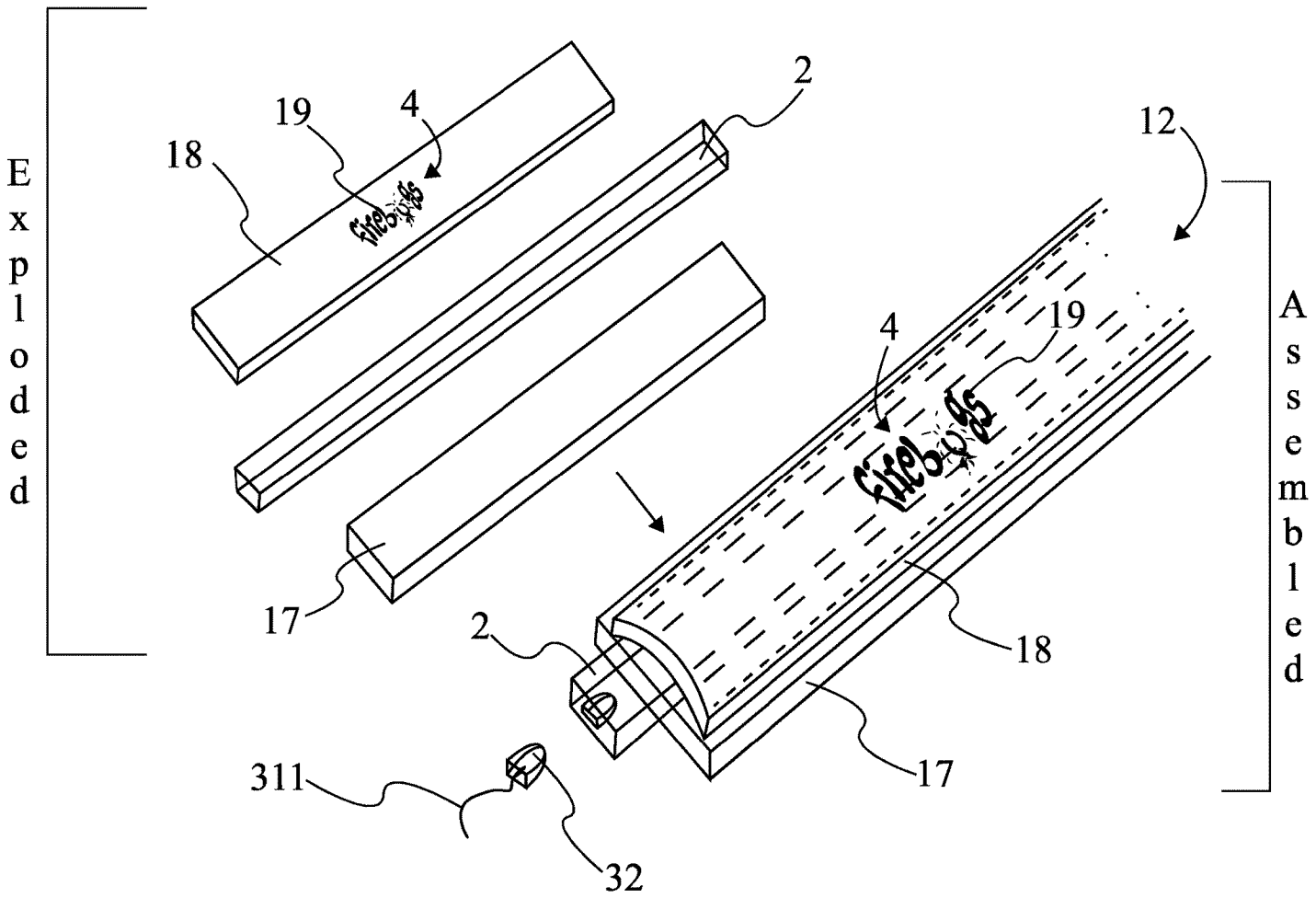
FIG. 7 is an assembly view showing an aesthetic design created by a stencil of the present invention.

In a third example, the upper 12 comprises the opaque light refracting section 18, as with the previous two examples. Furthermore, a light-impermeable stencil 19 is provided. The light-impermeable stencil 19 is adjacently connected to the opaque light refracting section 18, on a side of the upper 12 that is opposite and overlaid with the translucent body 2. The light-impermeable section is configured into an aesthetic design 4, such that emitted light illuminates the negative space around the aesthetic design 4; thus the design is created in the negative. This is in reverse of the previously described examples, where a positive image is formed. This configuration is illustrated in FIG. 7.

It is noted that for a boot style footwear 1 with aesthetic design 4, it is obvious that the connection point of the light source 32 to the translucent body 2 (and more specifically the aesthetic design 4) would be located in the boot shaft, rather than the sole section 11.

Figure 8:
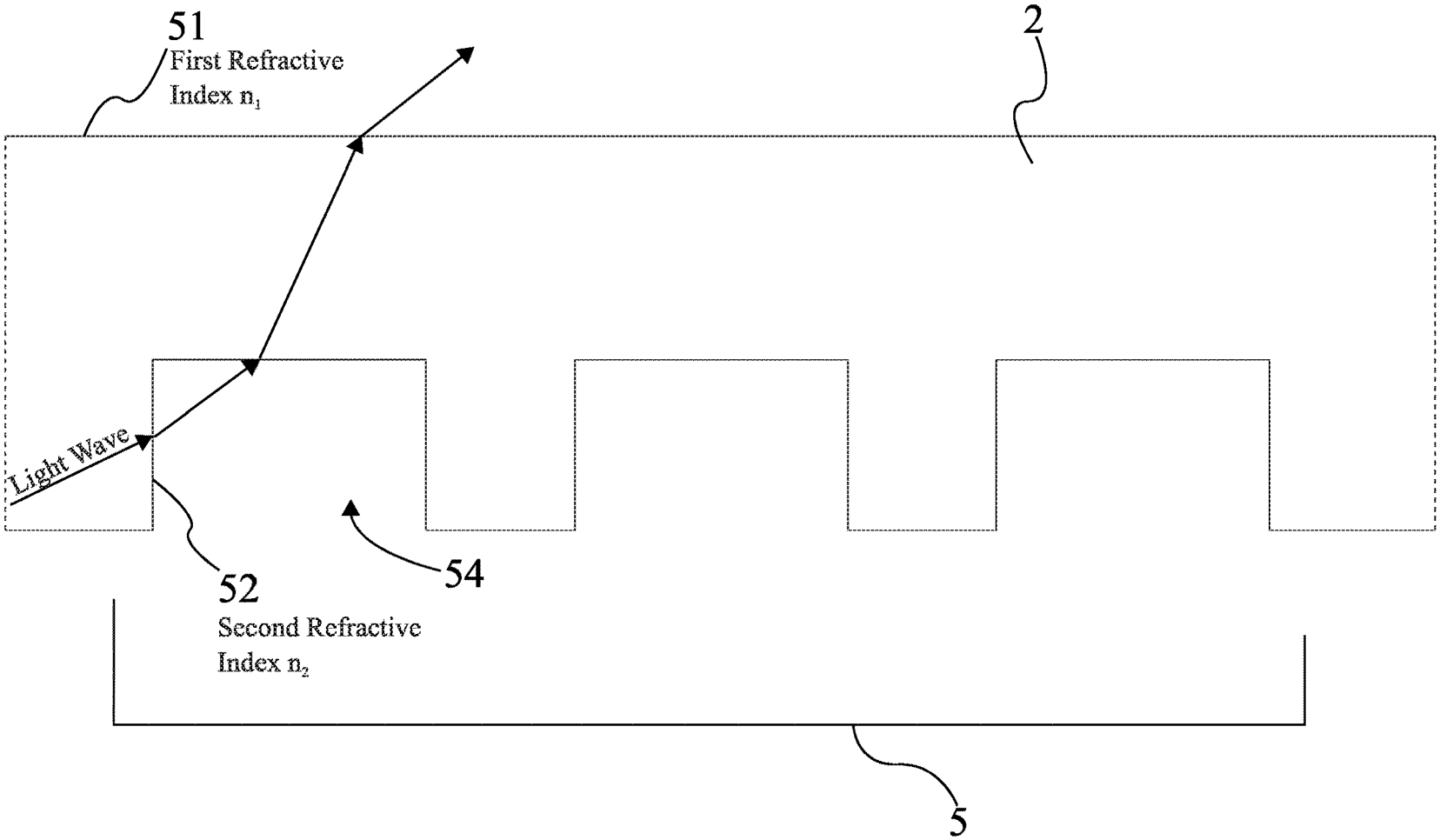
FIG. 8 is a diagram showing effects of a cavity style boundary section on refraction of light.
Figure 9:
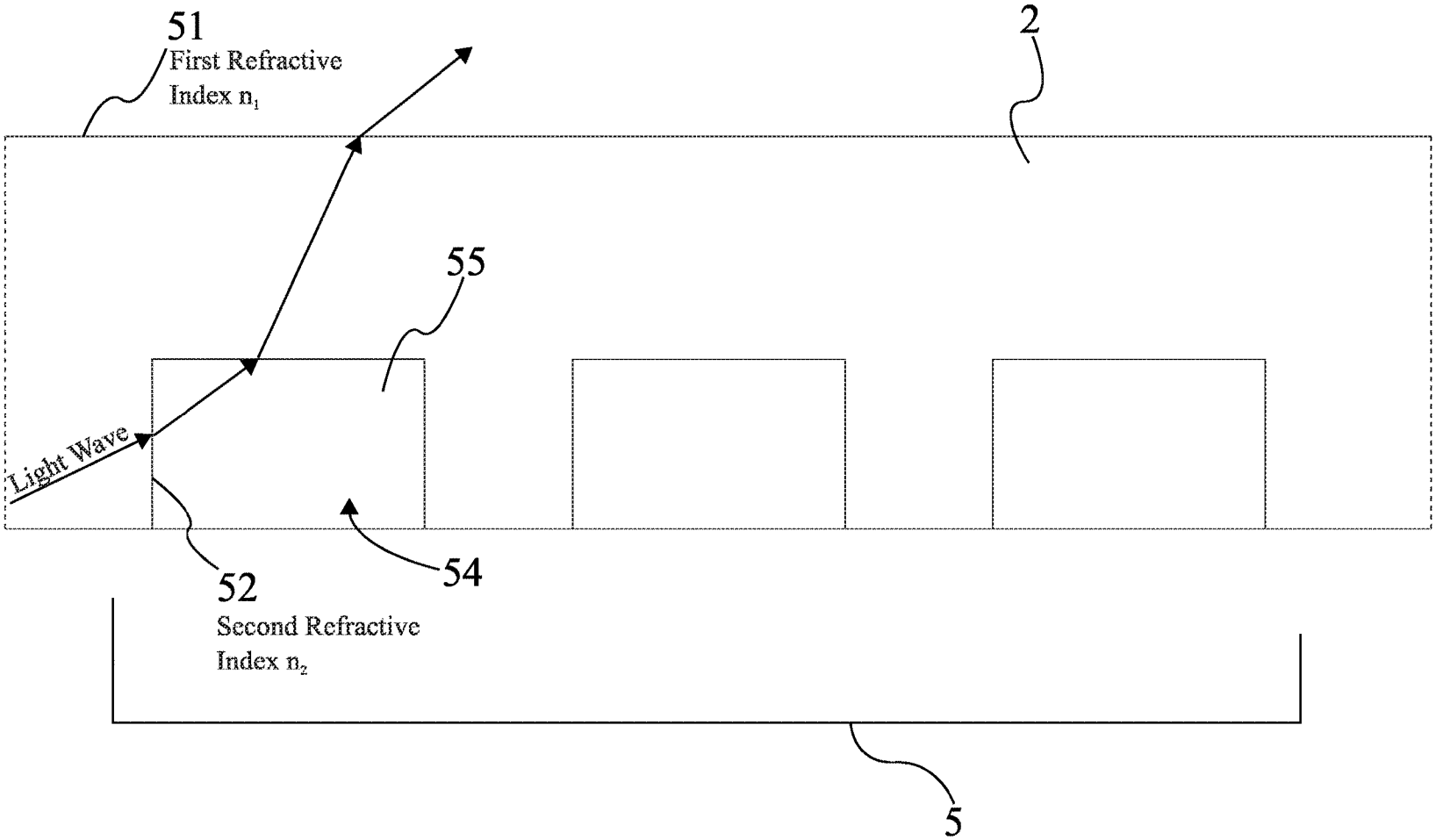
FIG. 9 is a diagram showing effects of a material style boundary section on refraction of light.
Figure 10:
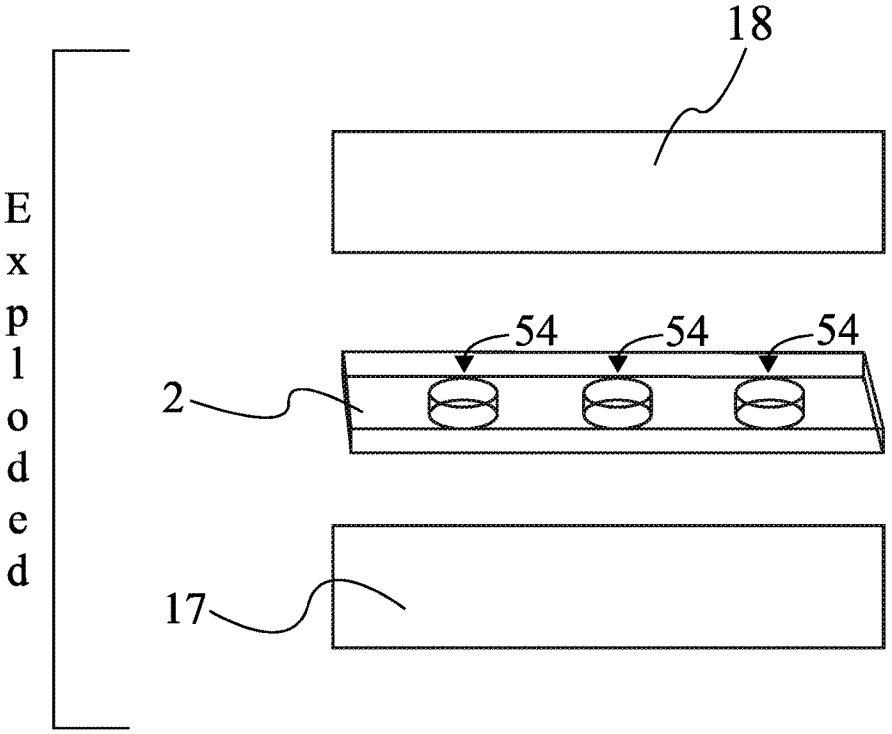
FIG. 10 is an exploded view showing cavity style boundary sections along a translucent body of the present invention.

In both of the aforementioned embodiments (i.e. closed footwear and open footwear), enhancements can be made to the translucent body 2 for an improved illumination effect. One such enhancement is a plurality of refractive boundary sections 5 which are positioned along the translucent body 2. Given a first refractive index 51 of the translucent body 2 and a second refractive index 52 of the plurality of boundary sections, enhanced refraction of light is created as light passes between the translucent body 2 and the plurality of refractive boundary sections 5. The path of the light is shown in FIG. 8 and FIG. 9. The specific size, shape, and number of boundary sections 5 is variable and can change between different embodiments of the present invention. Such additions as the second refractive index 52, as created by cavities 54, of boundary sections 5, is an enhancement over the first refraction of light, refractive index 51 i.e. from the translucent body 2. One benefit of note is increased intensity and brightness of illumination of the footwear 1, obtained from extrusions 53 and cavities 54 as subsequently discussed. Several variations of enhancing the refraction of light are provided via FIG. 8-FIG. 12.

In another example, the plurality of refractive boundary sections 5 is formed as a plurality of cavities 54. The plurality of cavities 54 traverses into the translucent body 2, creating holes along the translucent body 2 that serve to refract light on a different index from that light which is otherwise refracted from the translucent body 2. The cavities 54 may traverse partially into or completely through the translucent body 2, as preferred by a manufacturer or other entity. Cavities 54, of boundary sections 5 may be formed as ornamental images such as graphics, letters or logos, all of which will refract light on a different index from that light otherwise refracted from the translucent body 2. As earlier specified, the first refracted light from the translucent body 2 is refracted a second time by the cylindrical elongated opaque strap 13 or the opaque light refracting section 18, of the upper 12. This is also true with the light which is refracted by cavities 54 of boundary sections 5, however being that cavities 54 refract light at a different index, this second index of light, when refracted a second time, further enhances the cylindrical elongated opaque strap 13 or the opaque light refracting section 18 with the ornamentation of graphics, letters or logos which appear in a much brighter light along the surface of the cylindrical elongated opaque strap 13 or the opaque light refracting section 18, compared to that twice-refracted light which was first refracted by the translucent body 2, and not cavities 54. These cavities 54 are shown via FIG. 8 and FIG. 10.

Figure 11:
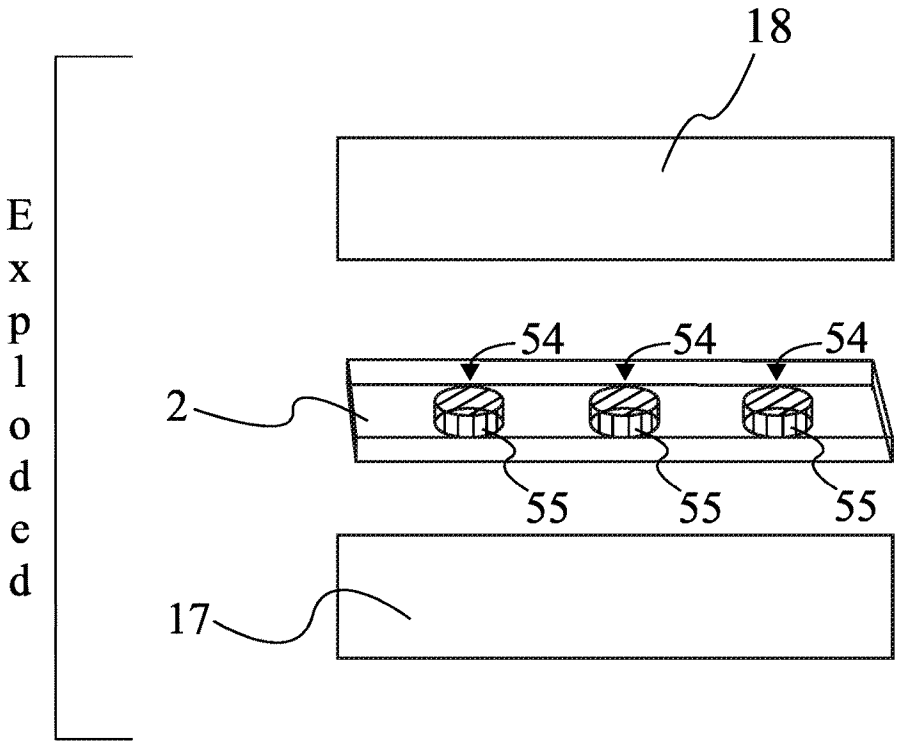
FIG. 11 is an exploded view showing material style boundary sections along a translucent body of the present invention.
Figure 12:
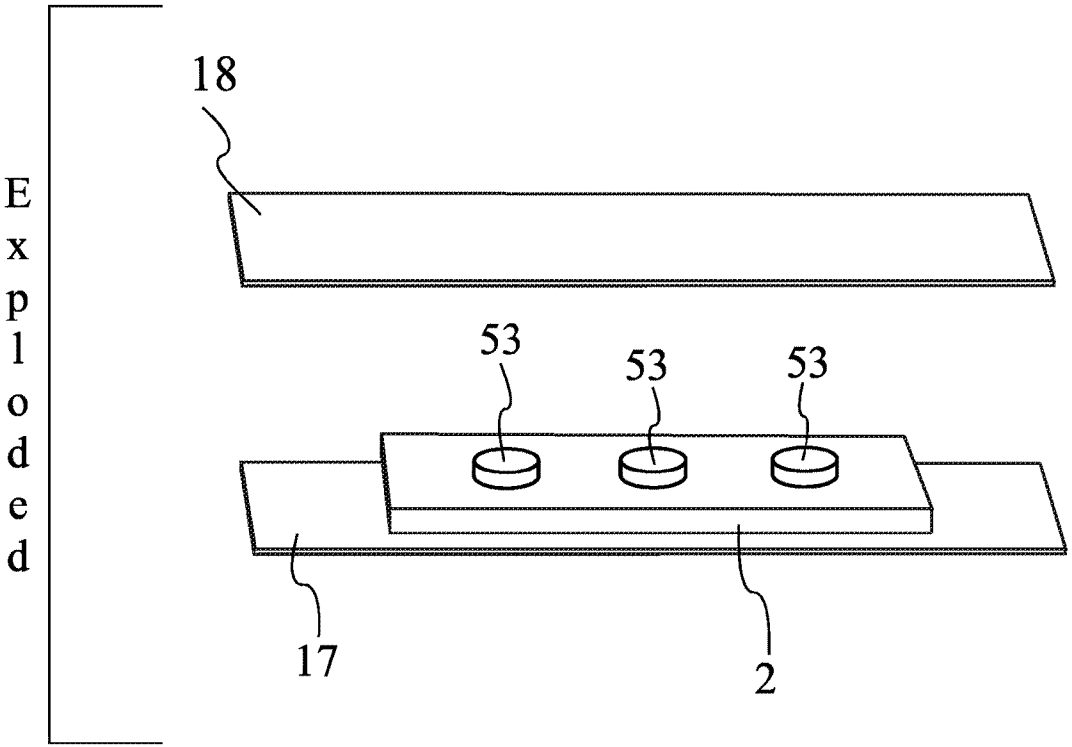
FIG. 12 is an illustration showing an embodiment utilizing translucent extrusions to create an aesthetic design.

Potentially, cavities 54 may be filled with a boundary material 55. The boundary material 55 may be opaque (i.e. non-light refracting) or translucent. If translucent, the translucent boundary material 55 will refract light on a different index from that light which is otherwise refracted from the translucent body 2, such as when cavities 54 are left empty. Application of a boundary material 55 is shown in FIG. 9 and FIG. 11.

Alternatively, cavities 54 can be replaced with translucent extrusions 53. Extrusions 53 are formed by a plurality of ridges and or bumps, rising above the surface area of translucent body 2. Extrusions 53 may replace the cavities 54 and or be used in combination with cavities 54, thus comprising boundary sections 5. As with cavities 54, such extrusions 53 will refract light on a different index than that light otherwise refracted by the translucent body 2, and may be used to form ornamental images such as graphics, letters or logos. An example of an embodiment with such extrusions 53 is provided via FIG. 12.

Cavities 54, of boundary sections 5, whether filled or left empty by boundary material 55, may be enhanced by means of a coarse surface. In other words, miniature features may be integrated long the surface of the boundary sections 5, with each such feature further enhancing the refraction of light. A coarse surface is applicable to both "empty" and "filled" (with boundary material 55) boundary section embodiments. Even in embodiments where boundary sections 5 are omitted, a coarse surface can be provided directly to the translucent body 2, still resulting in an improved refraction of light.

Ultimately, the present invention addresses the application of twice-refracted light to a footwear 1. Variations and enhancements to such twice-refracted light, as described heretofore, remain possible.

Figure 13:
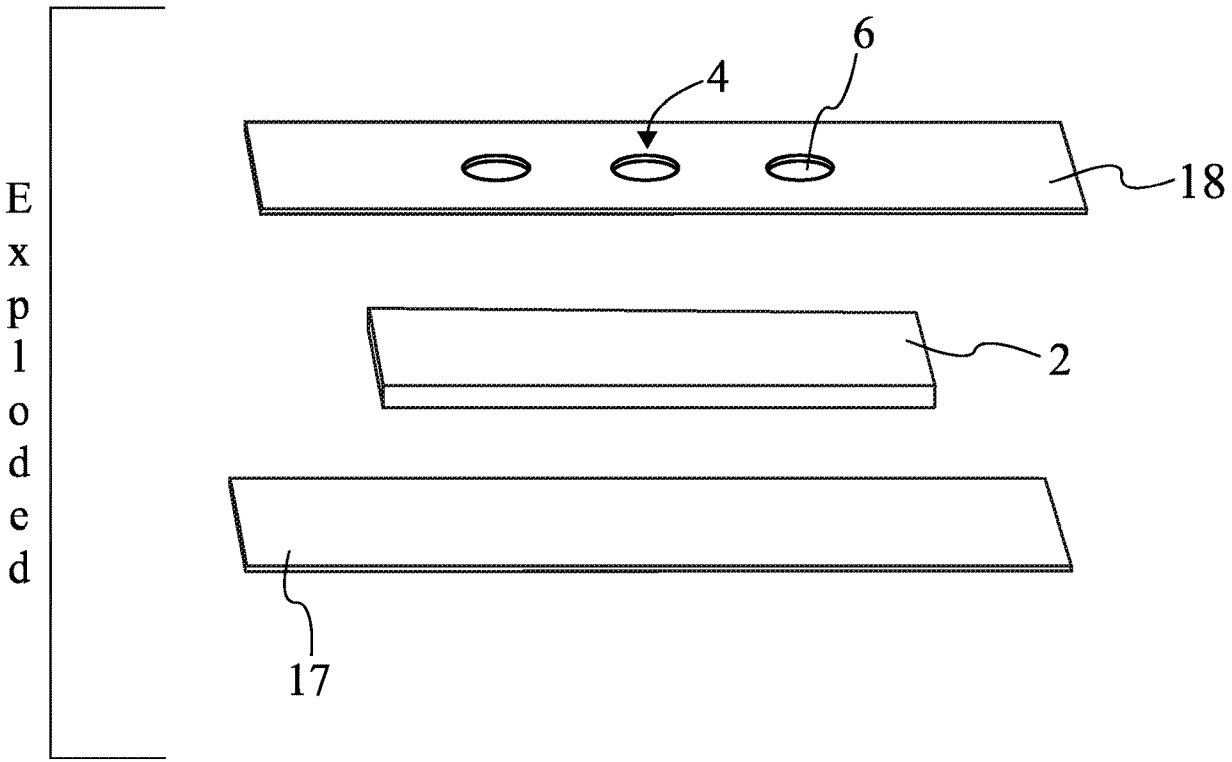
FIG. 13 is an exploded view showing the use of channels to create an aesthetic design.

Further possibilities for integrating aesthetic designs 4 into the upper 12 exist. For example, in one potential embodiment channels 6 can be cut into the upper 12. These channels 6 can be configured into aesthetic designs 4 for the cylindrical elongated opaque strap 13 or the opaque light refracting section 18 of the upper 12. The formed cylindrical elongated opaque strap 13 or the opaque light refracting section 18 is sharply defined by the channels 6, allowing for highly-defined aesthetic designs 4 to be applied to a footwear 1. A further possibility is the application of channels to a light-impermeable section; the channels 6 cut through the light-impermeable section to allow for the passage of light. When the channels 6 are configured into an aesthetic design 4, the light creates a positive image, as compared to the earlier example of a negative image formed by a light-impermeable stencil 19. An example of such is provided by FIG. 13.

Figure 14:
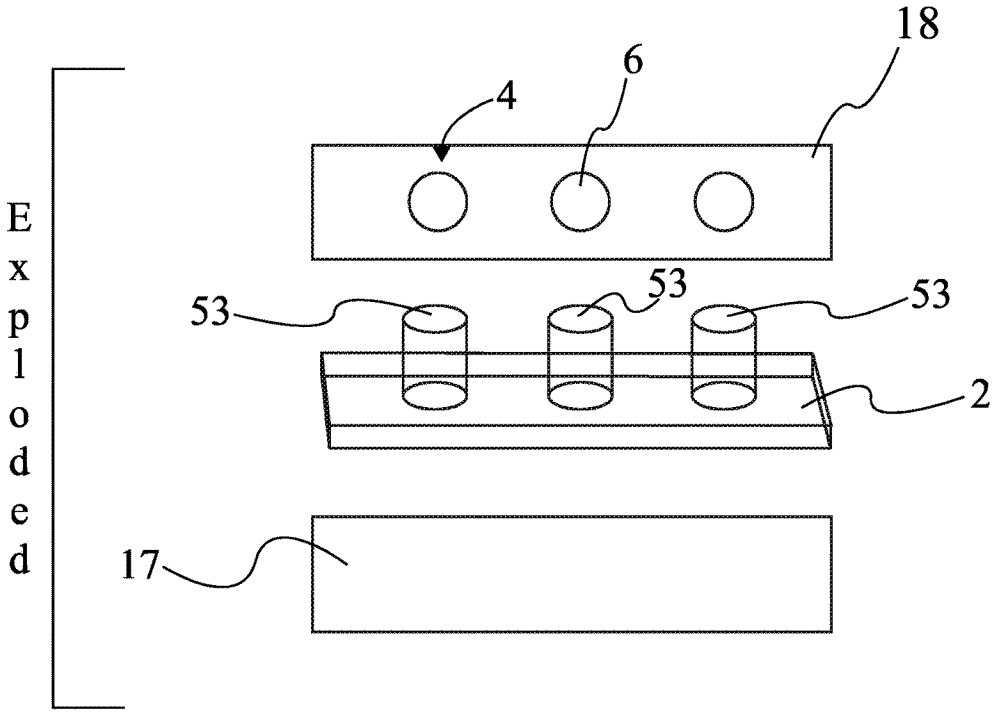
FIG. 14 is an exploded view showing an embodiment of the translucent body which contains extruded members.
Figure 15:
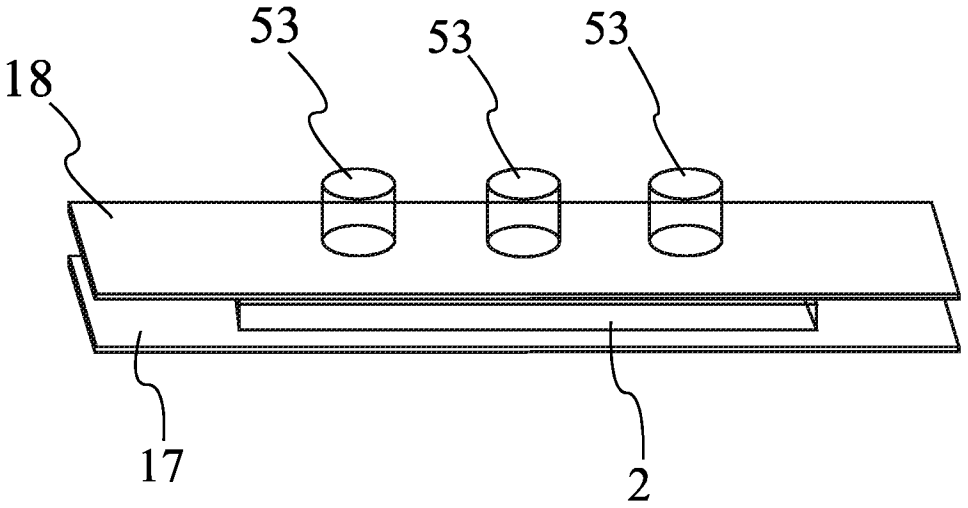
FIG. 15 is an assembled illustration showing the embodiment of the translucent body which contains extruded members.

Expanding upon embodiments which utilize channels 6, further possibilities include the use of extrusions 53, penetrating through channels 6, no matter if channels 6 are utilized in the cylindrical elongated opaque strap 13 or the opaque light refraction section 18 of the upper 12. Thus, extrusions 53 can be exposed through the upper 12 and give the appearance of individual illumination sources. Effectively, each extrusion 53 would be illuminated as if it had a corresponding illumination source. FIG. 14 and FIG. 15 serve as example illustrations for this potential embodiment.

More significant alterations are possible for the present invention, the following example being of note. Though not twice refracting, LED lights such as those mounted to a thin flexible strip, can replace the translucent body 2, resulting in light being refracted once. In such an embodiment, light from the at least one light source 32 would be refracted by the cylindrical elongated opaque strap 13 or the opaque light refracting section 18, resulting in radiant light across the surface of the cylindrical elongated opaque strap 13 or the opaque light refracting section 18, as viewed by an outside viewer.

As previously mentioned, the present invention provides an illuminated footwear 1 that applies twice-refracted light to create an enhanced internal illumination effect.

Figure 16:
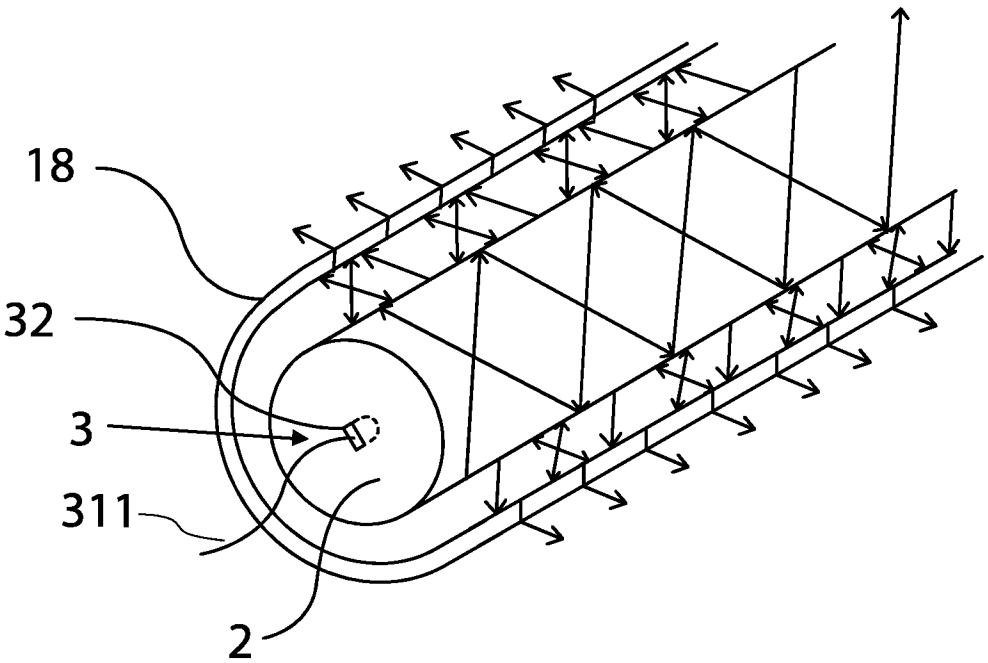
FIG. 16 is a diagram showing an enhanced internal illumination effect created by twice-refracted light.

Specifically, as shown in FIG. 16, the translucent body 2 is configured to refract light, the footwear 1 is configured such that the light then reflects between the translucent body 2 and the cylindrical elongated opaque strap 13 or the opaque light refracting section 18, and the cylindrical elongated opaque strap 13 or the opaque light refracting section 18 is configured to then refract the light to create twice-refracted light, whereby the twice-refracted light internally illuminates the cylindrical elongated opaque strap 13 or the opaque light refracting section 18.

Additionally, as previously mentioned, enhancements can be made to the translucent body 2 for an improved illumination effect.

Please refer to FIGS. 8-16, in the embodiment that the translucent body 2 comprises the plurality of refractive boundary sections 5, the translucent body 2 is configured to refract light at the first refractive index 51, the plurality of cavities 54 are configured to refract light at the second refractive index 52, the footwear 1 is configured such that the first refractive index of light and the second refractive index of light then reflect between the translucent body 2 and the cylindrical elongated opaque strap 13 or the opaque light refracting section 18, the cylindrical elongated opaque strap 13 or the opaque light refracting section 18 is configured to then refract the first refractive index and second refractive index of light to create twice-refracted light, whereby the first refractive index of twice-refracted light and the second refractive index of twice-refracted light internally illuminate the cylindrical elongated opaque strap 13 or the opaque light refracting section 18, and whereby the second refractive index of twice-refracted light appears as brighter points of light on the cylindrical elongated opaque strap 13 or the opaque light refracting section 18 as compared to the first refractive index of twice-refracted light.

Although the invention has been explained in relation to its preferred embodiment, it is to be understood that many other possible modifications and variations can be made without departing from the spirit and scope of the invention as hereinafter claimed.

What is claimed is:

1. A footwear with refractive internal illumination comprising:

a footwear;

a translucent body;

an illumination system;

the footwear comprising a sole section and an upper;

the upper comprising an opaque light refracting section and a liner;

the illumination system comprising a power source and at least one light source;

the at least one light source being electrically connected to the power source;

a light wavelength of light emitted from the at least one light source being approximate to a light wavelength of the opaque light refracting section;

the upper being connected to the sole section;

the at least one light source being connected to the translucent body;

the translucent body being housed in between the opaque light refracting section and the liner;

the translucent body being configured to refract light, the footwear being configured such that the light then reflects between the translucent body and the opaque light refracting section, the opaque light refracting section being configured to then refract the light to create twice-refracted light, whereby the twice-refracted light internally illuminates the opaque light refracting section;

the translucent body comprising a plurality of refractive boundary sections;

the plurality of refractive boundary sections comprising a plurality of cavities;

the translucent body comprising a first refractive index;

each of the plurality of refractive boundary sections comprising a second refractive index; and the translucent body being configured to refract light at the first refractive index, the plurality of cavities being configured to refract light at the second refractive index, the footwear being configured such that the first refractive index of light and the second refractive index of light then reflect between the translucent body and the opaque light refracting section, the opaque light refracting section being configured to then refract the first refractive index and second refractive index of light to create twice-refracted light, whereby the first refractive index of twice-refracted light and the second refractive index of twice-refracted light internally illuminate the opaque light refracting section, and whereby the second refractive index of twice-refracted light appears as brighter points of light on the opaque light refracting section as compared to the first refractive index of twice-refracted light.

2. The footwear with refractive internal illumination as claimed in claim 1 comprising:

the opaque light refracting section being connected to the sole section.

3. The footwear with refractive internal illumination as claimed in claim 1 comprising:

the opaque light refracting section being configured into an aesthetic design; and the aesthetic design being configured to be delineated by the light in response to the light being emitted from the at least one light source.

4. The footwear with refractive internal illumination as claimed in claim 1 comprising:

the translucent body being configured into an aesthetic design; and the aesthetic design being configured to be delineated by the light in response to the light being emitted from the at least one light source.

5. The footwear with refractive internal illumination as claimed in claim 1 comprising:

a light-impermeable stencil;

the light-impermeable stencil being adjacently connected to the opaque light refracting section, opposite the translucent body;

the light-impermeable stencil being configured into an aesthetic design; and the aesthetic design being configured to be delineated by the light in response to the light being emitted from the at least one light source.

6. The footwear with refractive internal illumination as claimed in claim 1 comprising:

the plurality of refractive boundary sections being disposed along the translucent body.

7. The footwear with refractive internal illumination as claimed in claim 1 comprising:

the second refractive index being different from the first refractive index.

8. The footwear with refractive internal illumination as claimed in claim 1 comprising:

the plurality of refractive boundary sections comprising a plurality of translucent extrusions;

the plurality of translucent extrusions being disposed along the translucent body; and the plurality of translucent extrusions being covered by the opaque light refracting section.

9. The footwear with refractive internal illumination as claimed in claim 1 comprising:

the plurality of cavities traversing into the translucent body.

10. The footwear with refractive internal illumination as claimed in claim 1 comprising:

a boundary material;

the boundary material being positioned into each of the plurality of cavities; and the plurality of refractive boundary sections being delineated by the plurality of cavities.

* * * * *